US005322056A

United States Patent [19]

Menghi et al.

[11] Patent Number: 5,322,056

[45] Date of Patent: Jun. 21, 1994

[54] SELF-MASSAGING INSOLE FOR SLIPPERS OR MULES

[75] Inventors: Emanuela Menghi, Macerata; Alberto Sabbatini, Loreto, both of Italy

[73] Assignee: Menghi Shoes - S.R.L., Italy

[21] Appl. No.: 962,407

[22] Filed: Oct. 16, 1992

[30] Foreign Application Priority Data

Jun. 5, 1992 [IT] Italy ..... AN92A000020

[51] Int. Cl.[5] ..... A61H 7/00

[52] U.S. Cl. ..... 601/136; 36/11.5; 601/27; 601/134

[58] Field of Search ..... 128/25 B, 60, 61, 62 R; 36/141, 32 R, 11.5, 28; 606/204

[56] References Cited

U.S. PATENT DOCUMENTS

| | | | |
|---|---|---|---|
| D. 294,076 | 2/1988 | Birrittella | 36/11.5 |
| 3,595,244 | 7/1971 | Kugler | 128/25 B |
| 3,722,113 | 3/1973 | Birkenstock | 36/141 |
| 3,757,774 | 9/1973 | Hatuno | 128/25 B |
| 3,885,555 | 5/1975 | Nobbs | 128/25 B |
| 4,000,566 | 1/1977 | Famolare | 36/32 R |
| 4,079,526 | 3/1978 | Fukuoka | 36/11.5 |
| 4,694,831 | 9/1987 | Seltzer | 36/141 |
| 4,852,553 | 8/1989 | Voykin | 128/25 B |
| 4,956,927 | 9/1990 | Misevich | 36/28 |

FOREIGN PATENT DOCUMENTS

| | | | |
|---|---|---|---|
| 0100067 | 7/1983 | European Pat. Off. . | |
| 279933 | 8/1988 | European Pat. Off. | 36/11.5 |
| 3503960 | 8/1986 | Fed. Rep. of Germany . | |
| 9001492 | 7/1990 | Fed. Rep. of Germany . | |
| 2066049 | 7/1981 | United Kingdom . | |
| 2123696 | 2/1984 | United Kingdom | 128/25 B |

*Primary Examiner*—Robert A. Hafer
*Assistant Examiner*—David Kenealy
*Attorney, Agent, or Firm*—Leonard Bloom

[57] ABSTRACT

The instant invention concerns a molded insole for slippers or mules, with clusters of bristles for the massage of the sole of the foot. In more detail, each group of bristles juts out from the bottom of a containing recess on the insole, in such a way that only the end part of each bristle juts upwards with respect to the the surface defined by the flat areas connecting the series of recesses.

5 Claims, 1 Drawing Sheet

SELF-MASSAGING INSOLE FOR SLIPPERS OR MULES

This patent application concerns an insole for slippers or mules, produced from moulding, which has clusters of bristles for the massage of the sole of the foot.

It is well-known and scientifically proven how healthy and beneficial foot massage is in stimulating and increasing blood circulation, sometimes deficient in the more peripheral joints.

These needs and well-being acquire even more importance in certain circumstances or work situations, where one is obliged to spend many hours of the day continuously on the move in some cases, or vice-versa, more or less standing still in others.

With these considerations in mind, for some time now moulded insoles have been available which are called self-massaging and which are able to carry out massaging action on the whole sole of the foot, due to the fact that they have a tightly-packed series of cylindrical bristles, with a rounded tip, jutting out from a profiled plate of uniform thickness; it being often provided that said bristles are of different heights in order to be able to create a resting surface in conformity with anatomical requirements. The massaging action is guaranteed by the elastic spring-back of said bristles, which are continually flexed in a non-uniform casual manner, according to the distribution of pressure when walking or when at rest.

However, it is true to say that not all the bristles on these insoles are able to flex under the weight of the body, in as much as most of them, as a result of their reduced height are practically rigid and consequently, unable to undergo any deformation of note under pressure. In other words, these protrusions of reduced height do not flex or get squashed, therefore, in actual fact, they are not able to contribute at all to the massaging action effected by the remaining bristles, those which are taller and thinner.

The aim of the instant invention is to produce a moulded insole, of the type described above, in which all the bristles however, have a slim shape which guarantees their ability to deform in an elastic manner under pressure. A further aim of the invention is to produce an insole with massaging bristles, able to carry out a massaging action on specific areas, limited to certain pre-established points on the sole of the foot, which correspond to those points defined as the "plantar reflective points". In fact, as is known, modern study has revealed that flux lines, which reach particular parts of the epidermis, branch off from certain of our internal body organs, and that by stimulating these parts it is possible to send stimuli directly to the internal organ concerned.

The sole of the foot comprises several of these "reflective points", each one linked with a specific organ in the circulatory or glandular or nervous system.

Rather than a general massage effected all over the sole of the foot, massage aimed only at specific areas which correspond to the terminal points of the aforementioned flux lines, is advisable.

In this way, it is possible to offer the sole of the foot a flat resting surface, which is therefore safer and more comfortable, interrupted only at certain points which correspond to needle-shaped islands, where the massaging action really produces stimulating and beneficial effects, outside of which any mechanical stimulation is practically ineffectual and superfluous.

In this light, the model in question was created, consisting of an insole, moulded in synthetic material or rubber, which has on its upper surface, namely where the sole of the foot rests, clusters of flexible bristles, which form needle shaped islands, linked by flat areas.

The distinctive feature of said clusters of bristles consists in the fact that each group of bristles juts out from the bottom of a recess on the insole, in such a way that only the end part of each bristle juts upwards in relation to the surface defined by the aforementioned flat connecting areas.

On the lower surface of the insole, there is a bearing framework, designed to sustain both the bottom of each recess and the flat connecting areas.

Said framework can be of any suitable configuration; for example, it can consist of a tightly-packed network of ribs, with a mesh of any poligonal, rectangular or rhomboid shape, square for example; alternatively said framework can consist of a closely-packed series of hollow supports of any transversal section.

For further clarity of explanation the description of the invention continues with reference to the attached drawings included for illustrative and not limitative purposes wherein.

Figure 2:
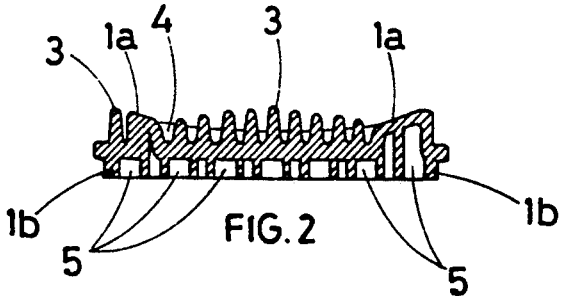
FIG. 2 is a section of FIG. 1, along the II—II plane.
Figure 1:
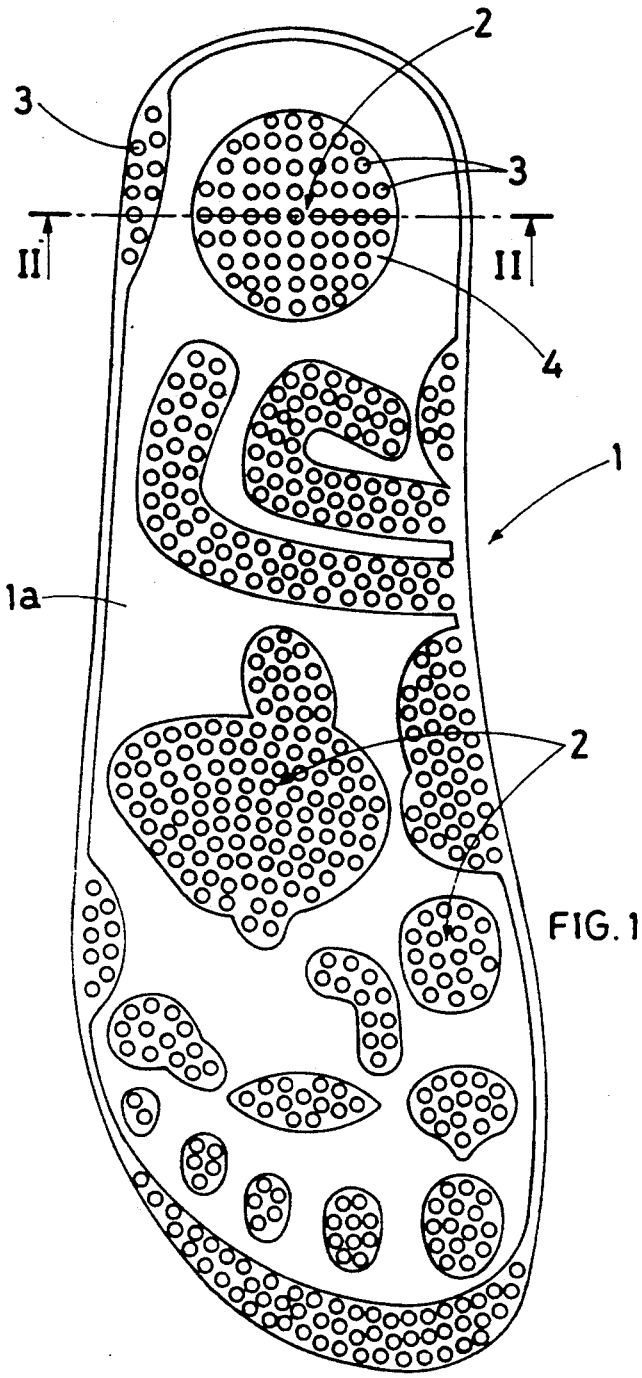
FIG. 1 is a schematic drawing of the upper surface of the insole according to the invention.
Figure 3:
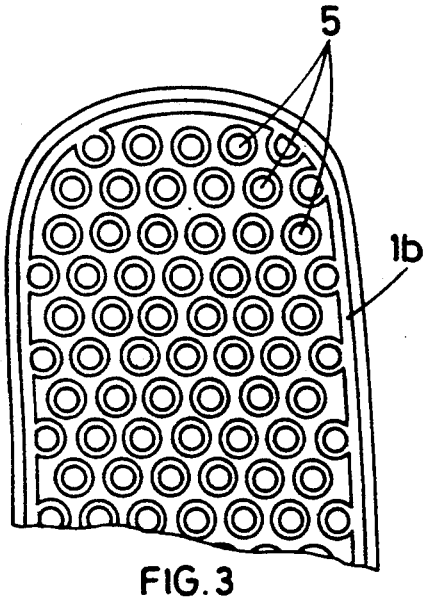
FIG. 3 shows a portion of the lower surface of the insole in question.

With reference to the aforementioned figures, the model in question consists of an insole (1), moulded in synthetic material or rubber, which can be applied to any kind of footwear, but is particularly suited to slippers or mules, which is the kind of footwear normally adopted as being the most comfortable by those people in the type of job which involves long hours standing.

The upper surface (1*a*) of said insole (1) has a flat surface in compliance with anatomical requirements, interrupted only at certain points which correspond to islands (2), made up of closely-packed bristles (3), jutting out from the bottom (4*a*) of recesses (4) of different depths and size according to the area in which they are positioned.

These recesses (4) are positioned both at the centre and at the edges of the insole (1); in the latter case, said recesses are open in as much as they do not have a closing edge on the external side.

Moreover, it should be indicated that the bristles (3) of each cluster are of different heights, gradually decreasing from the centre outwards, where the tip of the bristle juts slightly over the edge of the recess (4). The insole (1) has a lower perimetral edge (1*b*) of varying height, as a result of the anatomical profile of the upper surface (1*a*) of the insole (1).

This perimetral edge (1*b*) will adhere perfectly to the inside of the corresponding edge which marks the boundary of the cavity provided on the bottom of the slipper or mule to house the insole (1).

On the lower surface of the insole, a bearing framework is created during the moulding phase, which is made up of a closely-packed series of hollow cylinders (5), on a vertical axis, designed to support from underneath, both the bottom (4*a*) of the recesses (4) and the flat connecting areas between one recess and another.

In this sense, the perimetral edge (1*b*) also acts as a support, together with the frame on the lower surface of the insole (1).

With reference to the attached drawings, it is now much clearer exactly why in the insole in question, all the bristles are flexible and thus able to bend elastically under pressure from the foot, in such a way as to all be able to contribute to the massage of the sole.

In fact, all the bristles are thin and flexible, even those which jut slightly out from their recesses, in as much as their length when not bent is not measured from the edge of the recess, but from the bottom of the recess.

It is understood that this description refers to the attached drawing where, merely for illustrative purposes, one of the many possible versions of the insole according to the invention was shown.

It is particularly important to underline that the arrangement, extent and quantity of needle-shaped islands on the upper surface of the insole can on each occasion, be those most suited to final requirements, while still maintaining the instant inventive concept, according to which the bristles must all protrude from the bottom of a recess, from which only the tips of the bristles jut out.

An insole with bristles distributed uniformly over the whole top surface, jutting out from a single large recess, of the same size as the insole, also comes within the sphere of the instant inventive concept.

We claim:

1. A self-massaging insole for slippers or mules worn by a person, the insole being molded from a resilient material into an.anatomical shape, the insole having an outer edge, a lower surface and a substantially flat top surface, a plurality of spaced-apart recesses being formed in the flat top surface, each recess having a bottom portion, a plurality of spaced-apart flexible bristles being disposed on the bottom portion of each recess to form a group of flexible bristles about a center in each recess, the flexible bristles within each group being of varying heights, the heights of the flexible bristles within each group gradually decreasing outwardly from the center, each flexible bristle having a tip distal from the bottom of the recess, the tips of all of the flexible bristles extending above the flat top surface of the insole, and the lower surface of the insole having a bearing framework formed thereon.

2. The insole of claim 1, wherein a majority of the spaced-apart recesses are completely surrounded by the flat top surface and a minority of the recesses are open to the outer edge of the insole.

3. The insole of claim 1, wherein the groups of bristles are disposed at points corresponding to reflective points on a sole of a foot of the person wearing the slippers or mules.

4. The insole of claim 1, wherein the bearing framework has a parametrial edge corresponding to the slipper or mule and a series of closely packed, evenly spaced hollow cylinders, having uniform diameters, each hollow cylinder being disposed on a vertical axis, the series of hollow cylinders supporting the bottom of each recess and supporting the top surface of the insole between the spaced-apart recesses.

5. A self-massaging insole for slippers or mules worn by a person, the insole being molded from a resilient material into an anatomical shape, the insole having an outer edge, a lower surface and a substantially flat top surface, a plurality of spaced-apart recesses being formed in the flat top surface, a majority of the spaced-apart recesses being completely surrounded by the flat top surface and a minority of the recesses being open to the outer edge of the insole, each recess having a bottom portion, a plurality of spaced-apart flexible bristles being disposed on the bottom portion of each recess to form a group of flexible bristles about a center in each recess, the flexible bristles within each group being of varying heights, the heights of the flexible bristles within each group gradually decreasing outwardly from the center, each flexible bristle having a tip distal from the bottom of the recess, the tips of all of the flexible bristles extending above the flat top surface of the insole, the groups of bristles being disposed at points corresponding to reflection points on a sole of a foot of the person wearing the slippers or mules, the lower surface of the insole having a bearing framework, the bearing framework having a parametrial edge corresponding to the slipper or mule and further having a series of closely packed evenly spaced hollow cylinders having uniform diameters, each hollow cylinder being disposed on a vertical axis, the hollow cylinders supporting the bottom of each recess and supporting the top surface of the insole between the spaced-apart recesses.

* * * * *